US005205884A

United States Patent [19]

Rauscher

[11] Patent Number: 5,205,884

[45] Date of Patent: Apr. 27, 1993

[54] METHOD OF MAKING INSULATED STAINED GLASS UNIT

[76] Inventor: Anton Rauscher, 14 Cricket La., Norwalk, Conn. 06850

[21] Appl. No.: 615,475

[22] Filed: Nov. 19, 1990

[51] Int. Cl.[5] ..... B44F 1/06

[52] U.S. Cl. ..... 156/63; 52/311.1; 428/38

[58] Field of Search ..... 156/63, 293; 428/38, 428/63; 52/311

[56] References Cited

U.S. PATENT DOCUMENTS

| | | | |
|---|---|---|---|
| 2,991,213 | 7/1961 | Williams | 428/38 |
| 3,226,903 | 1/1966 | Lillethun | 52/311 |
| 3,420,730 | 1/1969 | Ellefson | 156/63 |
| 4,068,441 | 1/1978 | Shaffer | 52/308 |
| 4,217,326 | 8/1980 | Goralnik | 428/38 |
| 4,302,260 | 11/1981 | Meltzer | 156/63 |
| 4,746,695 | 5/1988 | Berly | 428/38 |
| 5,102,706 | 4/1992 | Latte | 428/63 |

FOREIGN PATENT DOCUMENTS

| | | | |
|---|---|---|---|
| 7009553 | 1/1971 | Netherlands | 428/38 |

*Primary Examiner*—Michael W. Ball
*Assistant Examiner*—Daniel J. Stemmer
*Attorney, Agent, or Firm*—Handal & Morofsky

[57] ABSTRACT

A method of making a stained glass type window and the window formed is disclosed. Pane members are cut into the required shapes arranged into the desired pattern and joined together. The stained glass type arrangement is joined to a finishing pane and may be incorporated into an insulated or thermopane structure.

8 Claims, 12 Drawing Sheets

FIGURE 1
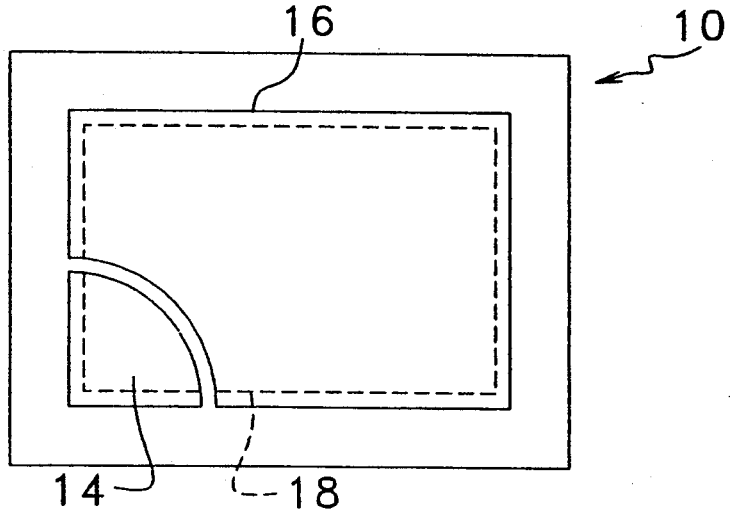
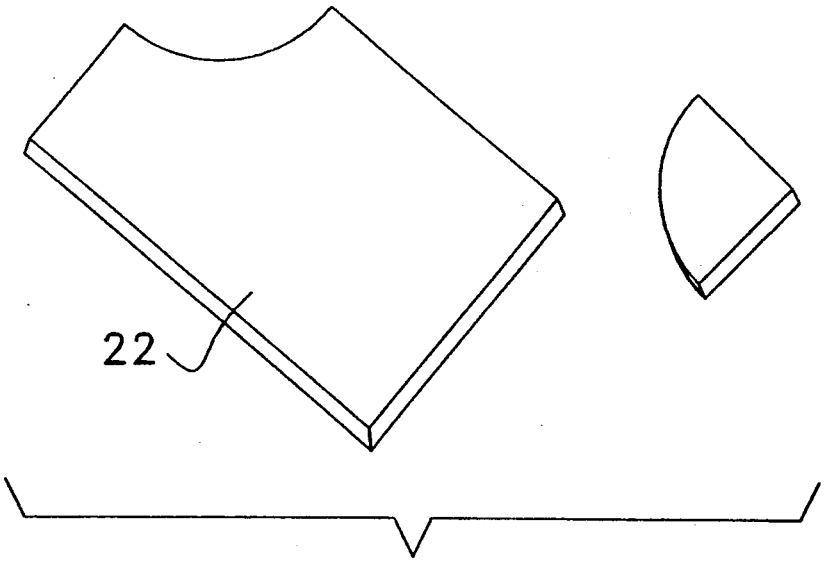
FIGURE 2

FIGURE 3
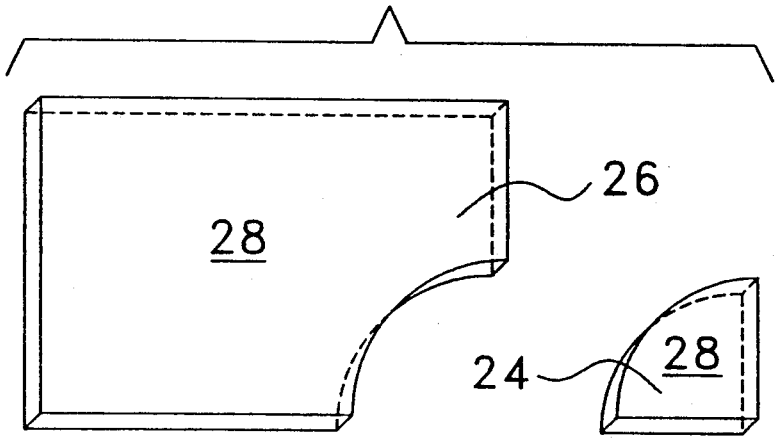
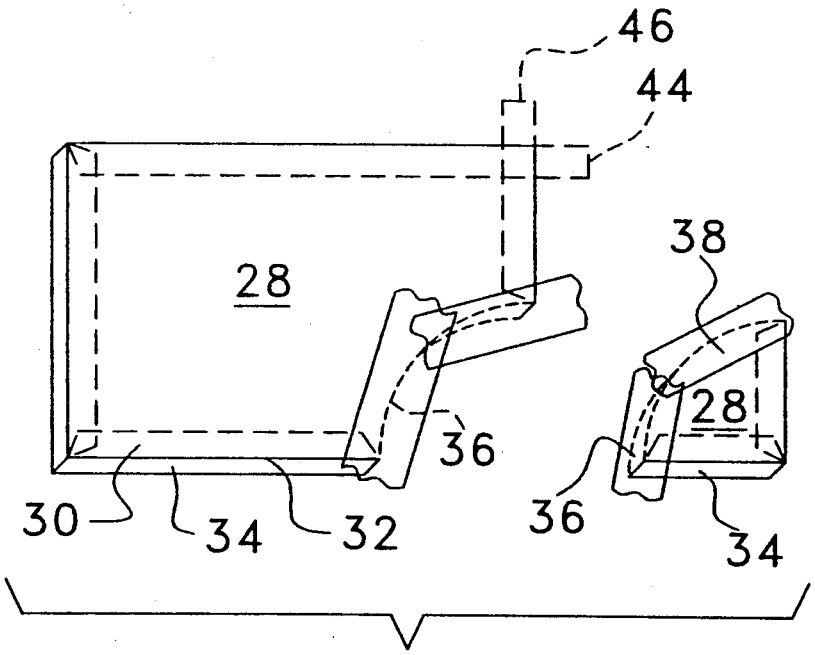
FIGURE 4

FIGURE 5
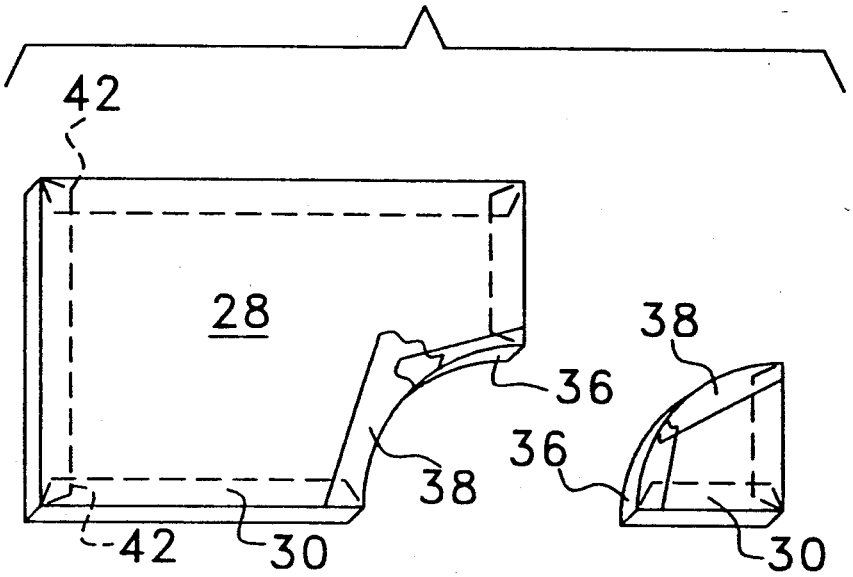
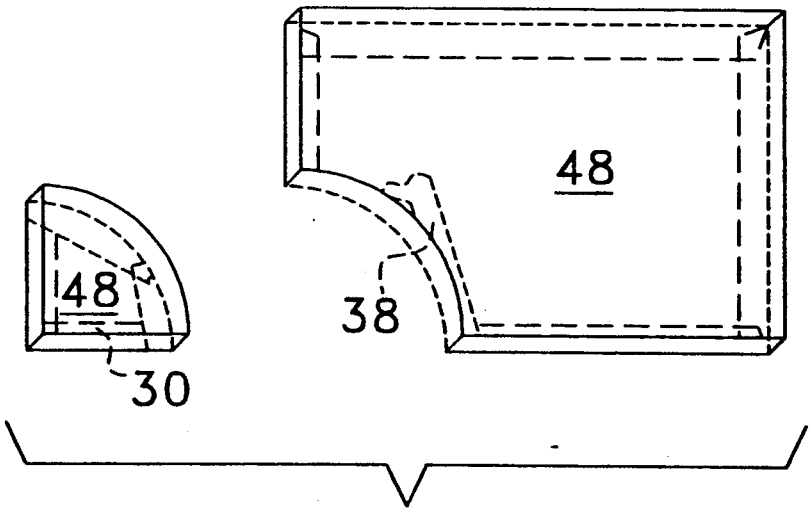
FIGURE 6

FIGURE 7
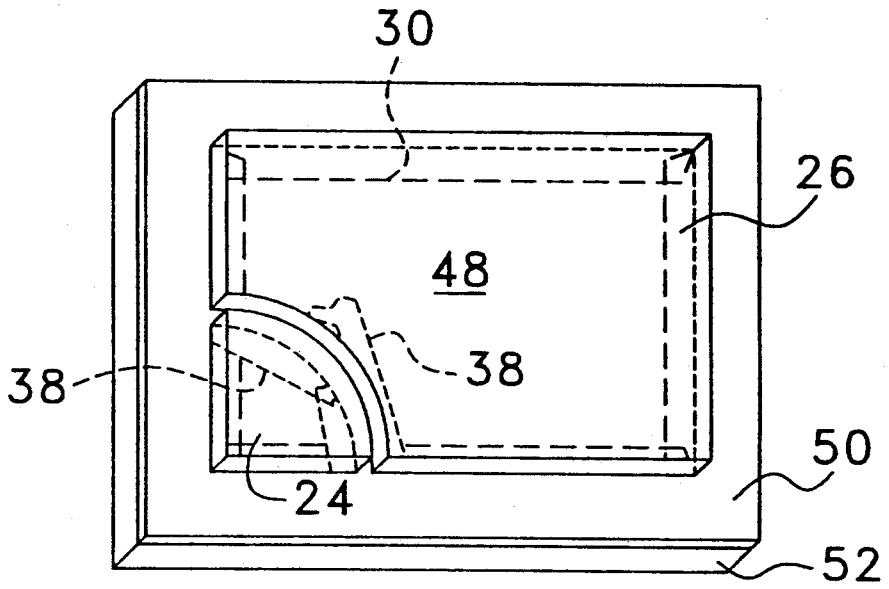
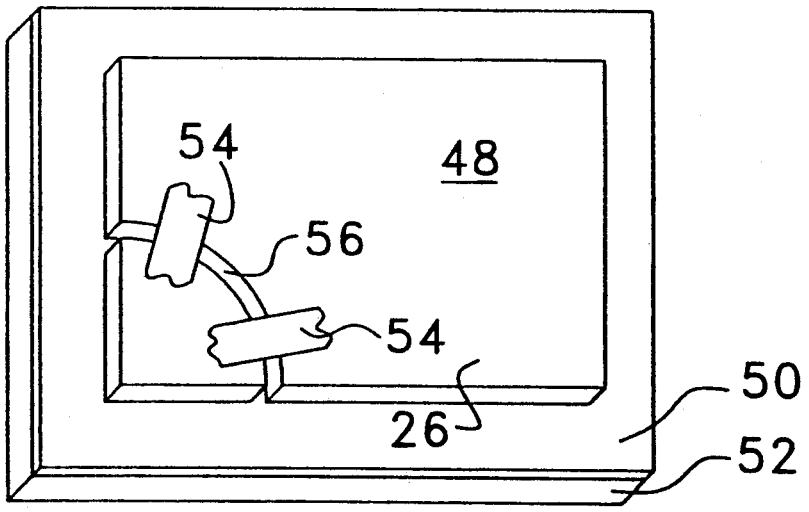
FIGURE 8

FIGURE 9
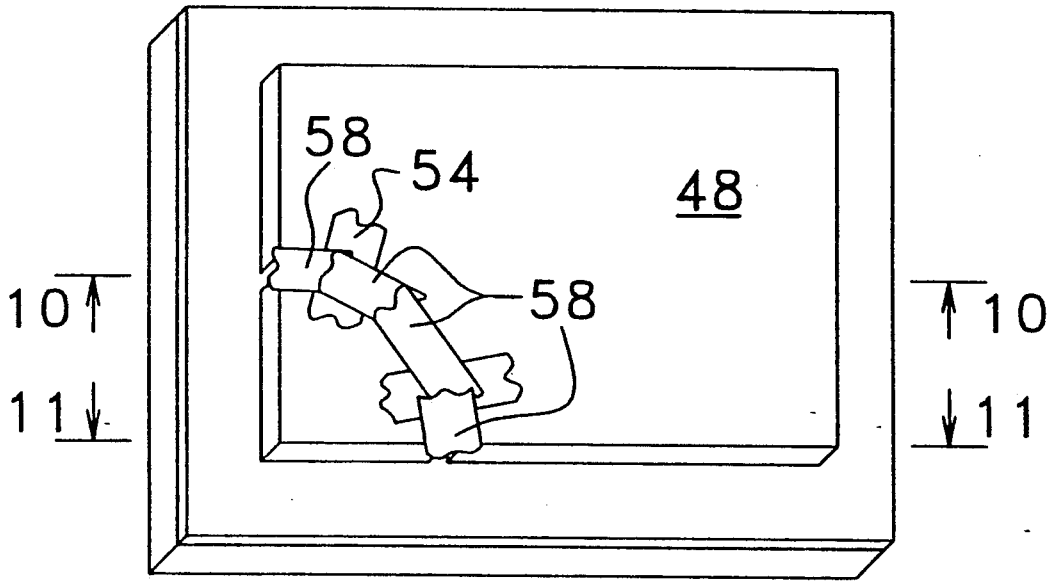
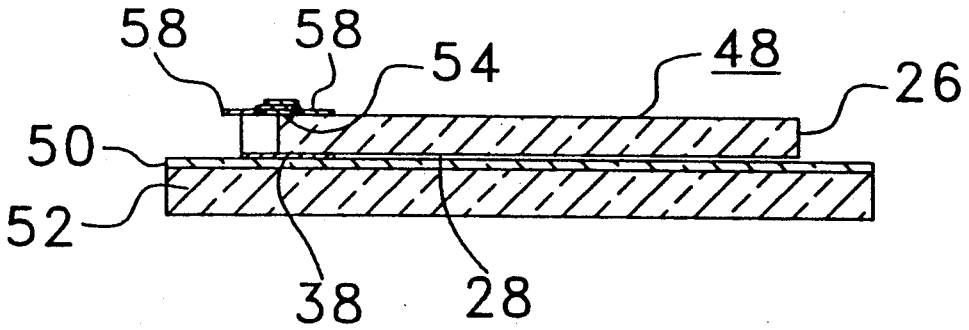
FIGURE 10

FIGURE 11
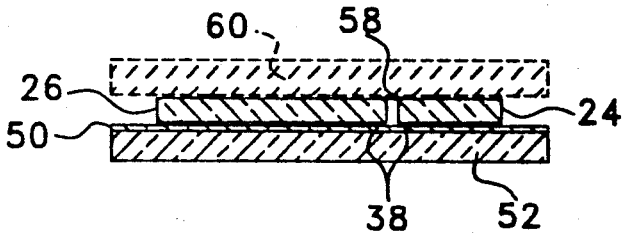
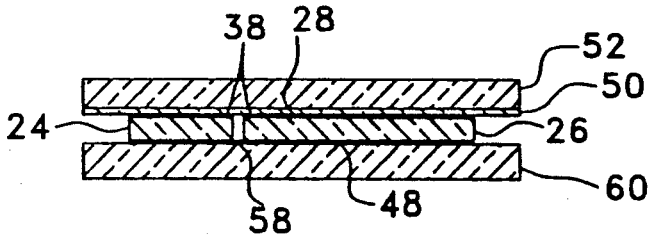
FIGURE 12
FIGURE 13
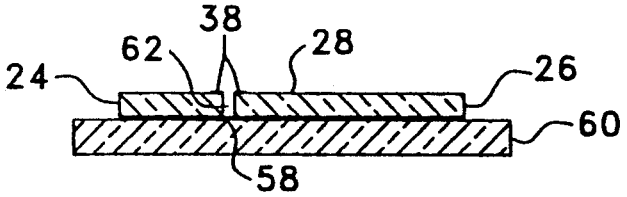
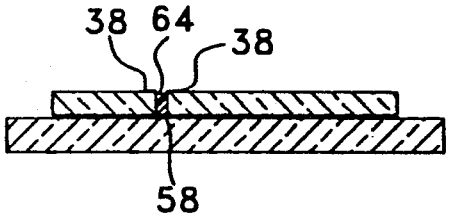
FIGURE 14

FIGURE 15
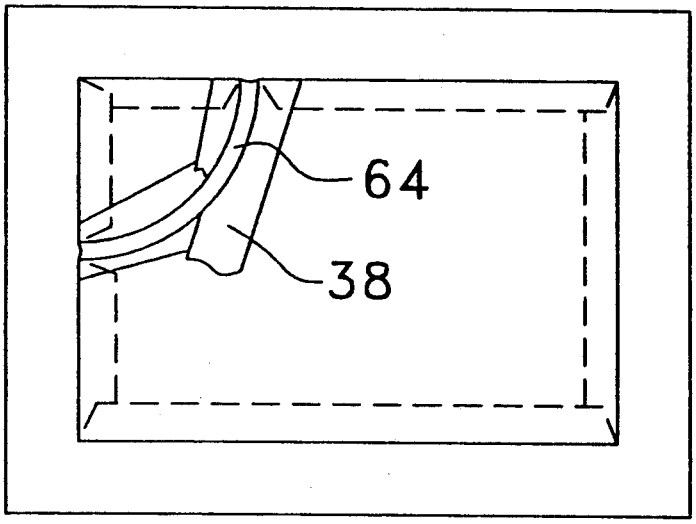
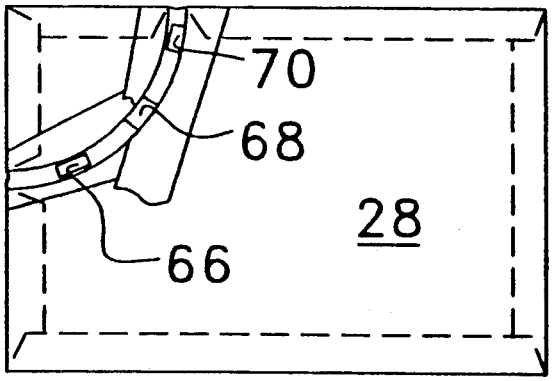
FIGURE 16

FIGURE 17
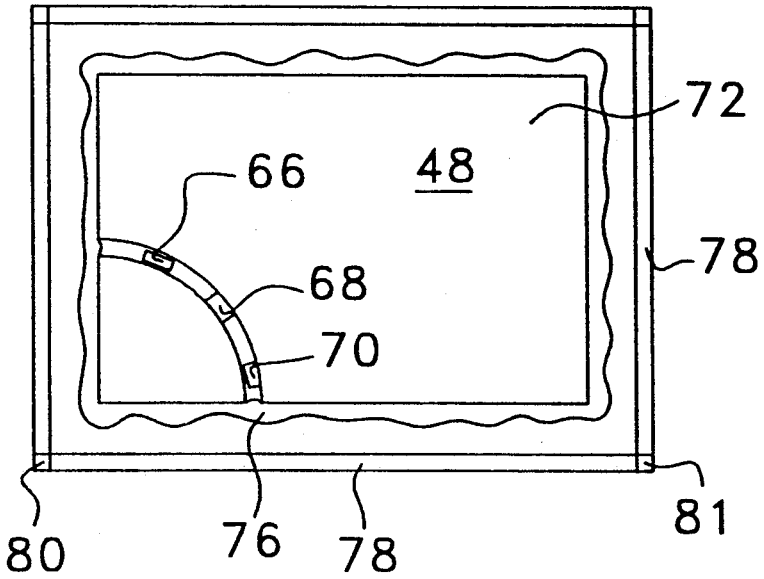
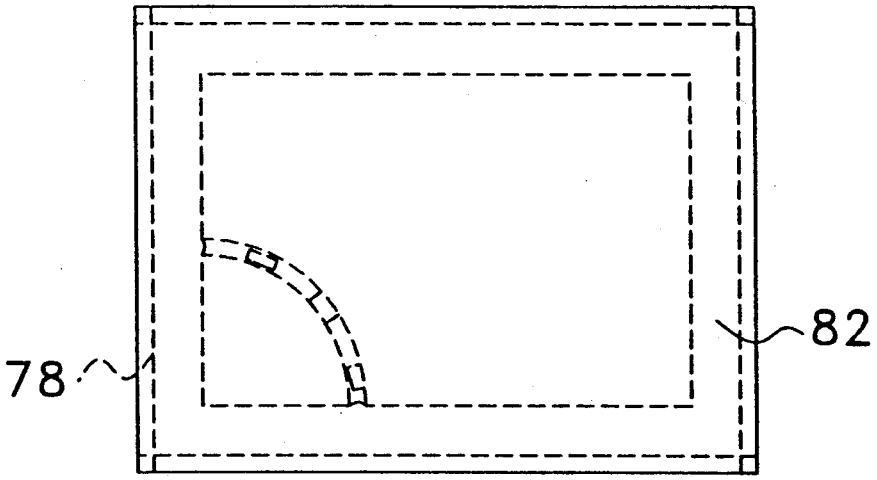
FIGURE 18

FIGURE 22
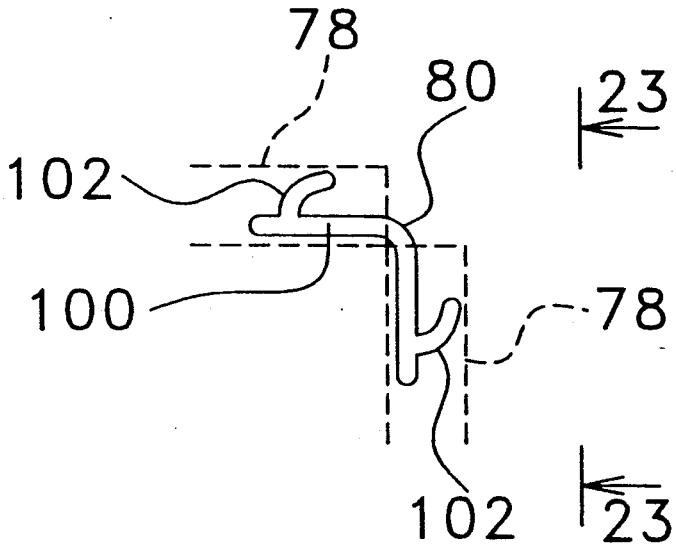
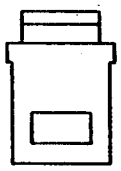
FIGURE 23

METHOD OF MAKING INSULATED STAINED GLASS UNIT

TECHNICAL FIELD

The present invention relates to methods for making multi-paned decorative window members of the type having patterns, pictures or the like formed by stained or clear glass members which are cut to various shapes and held together by came-simulating structure.

BACKGROUND

Since ancient times, homes, places of worship and other buildings have been decorated through the use of stained glass windows. These windows generally comprise leaded or stained glass members of different shapes and/or colors which together, when placed in a predetermined mosaic form a desired picture or pattern.

While the term "stained glass" is commonly used, it is generally a misnomer. Many coloring methods are and have been employed and the best medieval glass made little use of actual stained glass. Today, plastics are also used in place of glass.

In accordance with classical techniques, these pieces of glass are held together by lead or brass came. Generally, the came comprises a slender grooved lead rod which is used to hold together the panes of glass by being placed between them and being soldered to form the required support structure.

Such work requires a high degree of skill requiring precise cutting of the came to match the pattern, soldering of the came at the points where the metal came member ends meet other members and precise working of the glass into the came. Nevertheless, even with the highest level of skill, imperfections do occur. These imperfections become evidenced by deterioration of the stained glass window structure as the window ages. Deterioration generally takes the form of the introduction of leaks into the structure causing draftiness and the introduction of soot and other dirt into the room in which the stained glass window is located. More seriously, water also will leak through any deterioration or imperfection in the structure. This causes water to accumulate inside the cames causing serious corrosion and eventual disintegration of the structure.

Even without these imperfections, stained glass windows, due to the force of wind, rain and other environmental factors, tend to belly over time, causing further deterioration and compounding problems caused by drafts and leaks.

Still yet another problem with stained glass structures is the fact that they tend to become quite dirty and, because of the delicate nature of the stained glass window, cleaning is a time consuming, tedious and expensive task. This task is often complicated when the particular stained glass used has deep surface texture patterns which also tend to accumulate dirt. Accumulated dirt and other environmental particles also tend to retain moisture for a somewhat longer period of time than a clean window and, accordingly, any corrosion problems will be compounded by the same. This is particularly serious where a particular soldered joint may already be somewhat defective and deterioration of the good part of the joint may result in failure of the same.

In addition to all of the above, since the onset of the Industrial Revolution, acidity of the rain and the presence of other corrosive materials in the environment has introduced a further degree of seriousness to the deterioration of stained glass windows. This aspect is particularly troublesome because of the natural susceptibility of lead and other cam materials to dissolution in the presence of acid.

SUMMARY OF THE INVENTION

The invention, as claimed, is intended to provide a remedy. It solves the problem of how to manufacture a stained glass window which retains the appearance of a classical stained glass window while suffering from none of the above environmental problems. In addition, the method of manufacture of the inventive stained glass window is one which requires a relatively modest degree of skill and does not involve the expense of lead or solder. At the same time, the inventive stained glass window provides the added advantage of providing a degree of insulation not achievable with conventional stained glass windows.

The final inventive structure is, in accordance with the method of the present invention, provided substantially free of flaws and materials have the characteristic of high resistance to deterioration on account of environmental factors.

BRIEF DESCRIPTION OF THE DRAWINGS

One way of carrying out the invention is described in detail below with reference to drawings which illustrate only one specific embodiment of the invention and in which:

FIG. 1 is a view of a pattern useful for practicing the method of the present invention;

FIG. 2 is a view of templates made from a copy of the pattern of FIG. 1 useful for cutting glass;

FIG. 3 is a perspective view of stained glass panes for assembly in accordance with the method of the present invention;

FIG. 4 illustrates a tape shielding step for producing glass panes whose appearance is not defaced by excess material;

FIG. 5 is a view of the protective tape strips after their placement has been completed;

FIG. 6 is a reverse perspective view of the taped stained glass panes illustrated in FIG. 5;

FIG. 7 shows placement of the glass panes on a pattern in accordance with the method of the present invention;

FIG. 8 shows the securing the glass panes in position;

FIG. 9 is a perspective view similar to FIG. 8 showing the formation of a came forming member;

FIG. 10 is a cross-sectional view along lines 10—10 of FIG. 9;

FIG. 11 is a cross-sectional view along lines 11—11 of FIG. 9;

FIG. 12 is a view similar to FIG. 11 showing an intermediate step in the formation of the came-simulating member in accordance with the method of the present invention;

FIG. 13 illustrates the opening of the gaps for the installation of came;

FIG. 14 is a view similar to FIG. 13 showing the came after it has been installed;

FIG. 15 is a top-plan view of the system as illustrated in FIG. 14;

FIG. 16 is a top-plan view illustrating the formation of means for securing the stained glass assembly;

FIG. 17 is a top-plan view illustrating the successive filling of holes and securing of the stained glass member;

FIG. 18 is a view illustrating the formation of the insulating stained glass assembly;

FIG. 22 is a view of a corner joint useful in accordance with the method of the present invention;

FIG. 23 is a view along lines 23—23 of FIG. 22; and

BEST MODE FOR CARRYING OUT THE INVENTION

Figure 20:
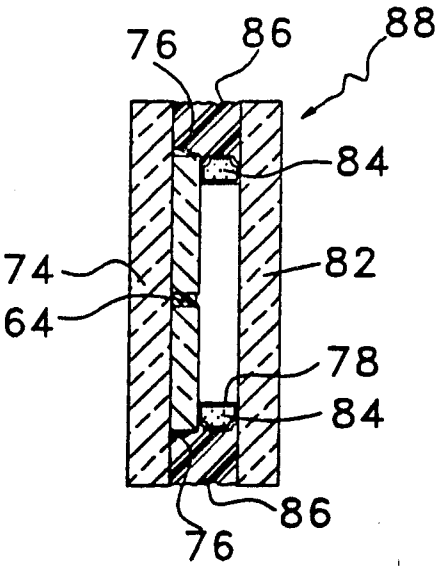
FIG. 20 is a view along lines 21—21 of FIG. 19 with the frame removed.

Referring to FIG. 1, the fabrication of a stained glass type window constructed in accordance with the present invention begins with the creation of a pattern 10 which is made of a sheet 12 of paper or other similar materials. Sheet 12 has thereon depictions of the various elements of the stained glass window. In the case of the example, such depiction includes a quarter 14 of a circle and a remainder shape 16.

In making the pattern for the stained glass window, it is important for the designer to keep in mind that the peripheral area of the colored members will be covered and that the visible area of the pattern will only be the central portion thereof. In the example of FIG. 1, this central portion is shown in imaginary lines 18. These lines may be actually drawn on sheet 12, although this is not necessary.

After the pattern 10 is made, several copies are produced by xerographic or other appropriate methods for use in later fabrication steps. One of these copies is then cut using a scissors, Exacto brand knife or a razor blade into the various shapes which are indicated for the stained glass elements. More particularly, in the example, as illustrated in FIG. 2, the quarter pattern is cut into a quarter template 20 and the shape pattern is cut into a shape template 22. It is noted that in FIG. 2 these templates have been turned over into the position that they will be used in during later steps in the manufacturing process.

After the templates have been cut from one of the pattern copies, the same are used to cut pieces of stained glass or other material with desired colors. This can be done by putting the template over the glass and marking the glass or cutting in the conventional manner. Alternatively, the pattern can be taped or otherwise held to a piece of glass and a cutting tool traced around the edge pattern to implement the various cuts required to make the shape.

After the cutting process, one then has pieces of glass or plastic which form the stained glass window. As illustrated in FIG. 3, a quarter pane 24 and a shaped pane 26 are thus formed of material having a color and/or texture desired.

After the panes have been formed, they are edged with tape on the periphery of their reversed side 28. As illustrated in FIG. 4, pieces of masking tape 30 are put around the edges of the panes with one edge 32 of tape 30 directly coinciding with its respective straight edge 3 of the pane. The process is done for all straight edges, as illustrated in FIG. 4. In the case of curved edges 36, tape 38 is made to overlie and extend beyond the edge 36, as illustrated in FIG. 4.

After this process has been completed for all of the panes, the excess of tape 38, which extended over the curved edges 36 of the panes is trimmed. It is noted that during the placement of tape over both straight edges 34 and curved edges 36, it is important that the entire edge be covered with tape. It is not necessary that the tape be cut to exact right angles and laid over both edges, as long as both of the edges extend to the corner. Thus, a rough cut edge 40 or 42 is acceptable as long as the combination of the two pieces of tape which form the corner are such as to ensure the complete coverage of the periphery of the pane. Alternately, it is also acceptable that the two pieces of the tape extend over the edge, as illustrated by tape extensions 44 and 46 as illustrated in FIG. 4. In the event of such overlapping extension, it is merely necessary for the excess to be trimmed using a razor blade so that the structure illustrated in FIG. 5 remains.

After having their peripheries taped, the panes are again turned over so that their face sides 48 are exposed, as illustrated in FIG. 6. The panes are then placed on a duplicate copy 50 of the pattern which is resting on a glass pane 52. Quarter pane 24 and shaped pane 26 are placed on top of pattern copy 50 with their bases on the precise positions indicated in pattern copy 50, as illustrated in FIG. 7. Panes 24 and 26 are positioned with their face sides 48 exposed.

The relative positions of the stained glass pane are then fixed using tape strips 54 which may also be masking tape. Tape strips 54 are positioned so as to hold stained glass panes 24 and 26 in position. This step in the process is illustrated in FIG. 8.

After the holding tape strips 54 have been placed as illustrated in FIG. 8, all joints 56 are completely closed with additional tape strips 58 as illustrated in FIG. 9. The structure then appears as in cross-section in FIGS. 10 and 11.

An additional glass pane 60 is then placed on top of the assembly illustrated in FIG. 9, as illustrated in phantom lines in FIG. 11. The entire assembly is then turned over as illustrated in FIG. 12 which is a cross-sectional view similar to that of FIG. 11.

After the assembly has been turned over as illustrated in FIG. 12, glass pane 52 and pattern copy 50 are then removed, leaving the assembly illustrated in FIG. 13 which is a cross-sectional view as in FIG. 11.

The next step in the process is the insertion of a silicon caulking compound into the gap 62 between the various stained glass panes. Such caulking 64 is put in the gaps substantially up to the height of tape 38 and is contained on the bottom by tape 58, as illustrated in FIG. 14.

For the manufacture of a stained glass window in accordance with the present invention, it is not necessary that those pieces of the stained glass pane which will form the edge of the stained glass window be edged in tape. However, such tape is shown in phantom lines in the figures in order to illustrate the placement of tape on straight edges in a much larger, more complex window, (for example, a stained glass window in which straight edges must be included which do not form the periphery of the stained glass assembly).

After all gaps 62 have been filled with caulking 64, the assembled stained glass element has substantially the appearance illustrated in FIG. 15. Tape 38 thus serves to protect the surface of the glass from becoming smeared with unsightly caulking material. Typically, silicon caulking material such as that sold under Federal Specification TT-S 001543A(COM-NBS) is used. This material is used in different colors including gray or silver, bronze and the like and thus ca be used to achieve the effect of brass or lead caming. In addition, other colors are available such as black.

The silicon caulking material is then allowed to dry. After drying, all tape is removed and holes 66, 68 and 70 are cut into the caulking. It is not necessary that the holes be cleaned and a variety of situations are acceptable. These include holes such as hole 66 cut completely within the caulking, hole such as hole 68 which are cut substantially to both glasses of the edge completely opening up gap 62 in that region and holes 70 which are open to the stained glass pane on only one side.

After the removal of the tape and the removal of the material made by the cutting of the holes, which may be made using a razor blade or Exacto brand knife, the stained glass assembly 72 is placed on a finishing glass pane 74. More silicon caulking is then put into holes 66, 68 and 70 and additional material is added to the periphery 76 of the stained glass element 72, as illustrated in FIG. 17. This results in securing the stained glass element 2 and all of the stained glass panes which comprise it to the finishing glass pane 74.

Figure 19:
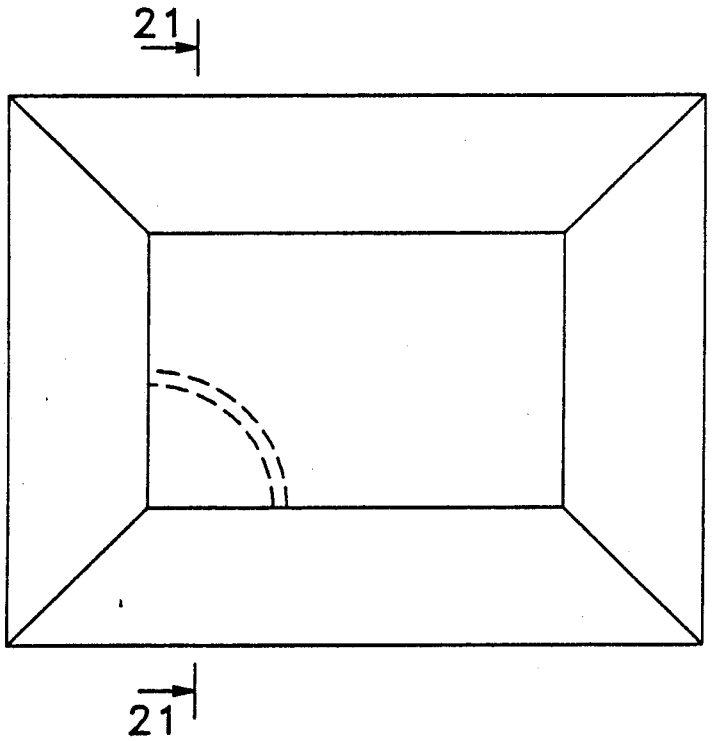
FIG. 19 illustrates the inventive stained glass assembly in a window frame.

After the caulking compound has been allowed to set for about twenty-four hours, four hollow air spacers 78 which act as separating members are positioned over finishing pane 74. Separating members 78 are held together by corner joints 80. The entire assembly is then covered with an external glass plate 82 as is illustrated in FIG. 18 for assembly into a finished unit as illustrated in FIG. 19.

Figure 21:
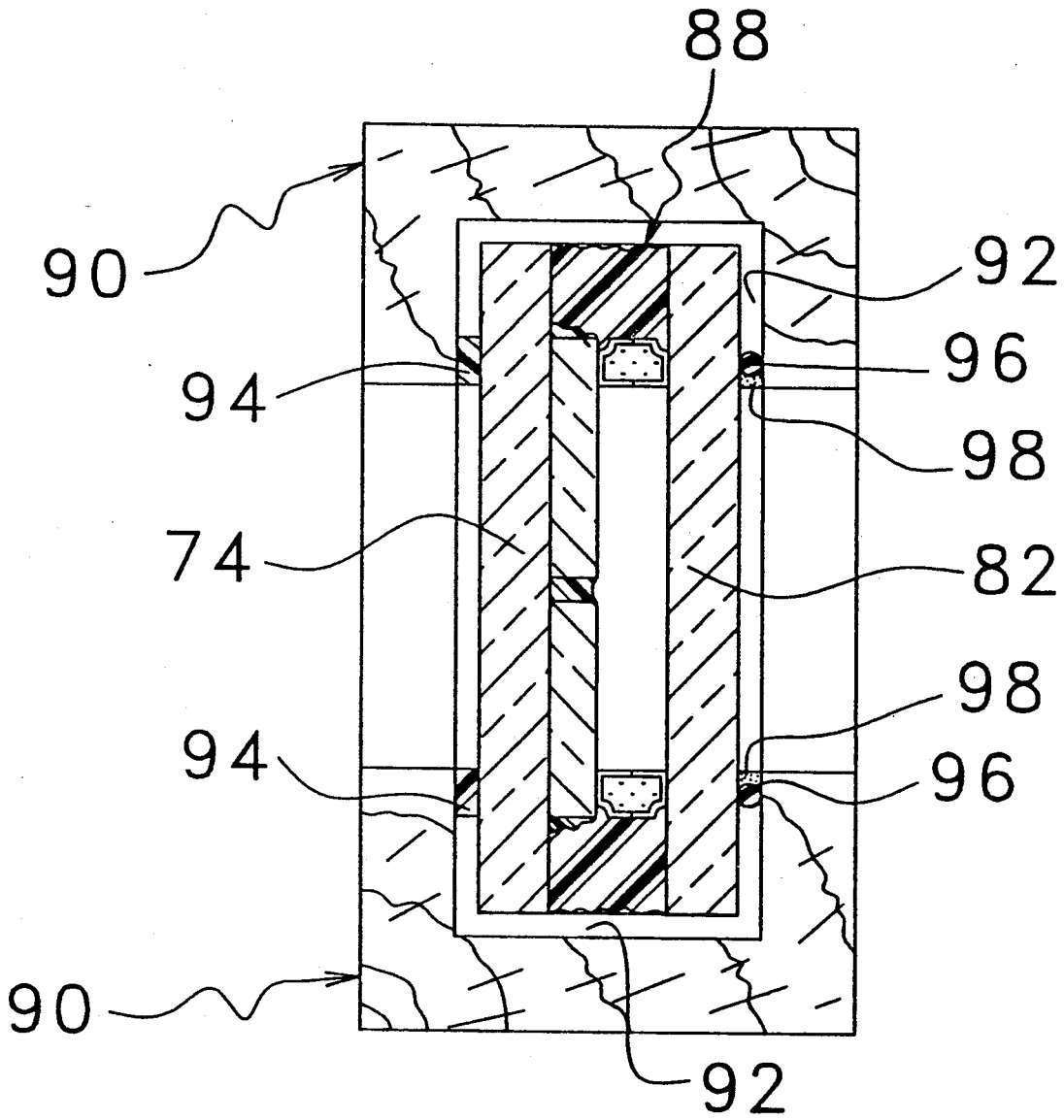
FIG. 21 is a view along lines 21—21 of FIG. 19.

Separating members 78 are filled with desiccant particles 84, such as silica gel, as illustrated in FIG. 20. The entire assembly is held together by additional caulking 86 which is introduced at the periphery of the system as indicated in FIG. 20. The finished insulated stained glass assembly 88 is then placed in a conventional frame, such as wooden frame 90 in FIG. 21. Frame 90 includes a channel 92 into which assembly 88 is placed. Prior to placement of the assembly within the frame, a rubber cushion 94 is put along one side of the channel. The assembly is then pressed against the same and the desired position achieved. At the same time, a rod-shaped rubber grommet 96 is pushed into the groove at the other side of assembly 88 thus holding the assembly in position. The installation is finished by sealing the window with caulking compound 98.

As noted above, separator members 78 are held together by corner joints 80 which have the general shape illustrated in FIG. 22 and 23. Generally, they comprise an L-shaped support member 100 and a pair of flexible engagement fingers 102. The corner joint is inserted into the ends of adjacent separator member 78, as illustrated in phantom lines in FIG. 22.

Figure 24:
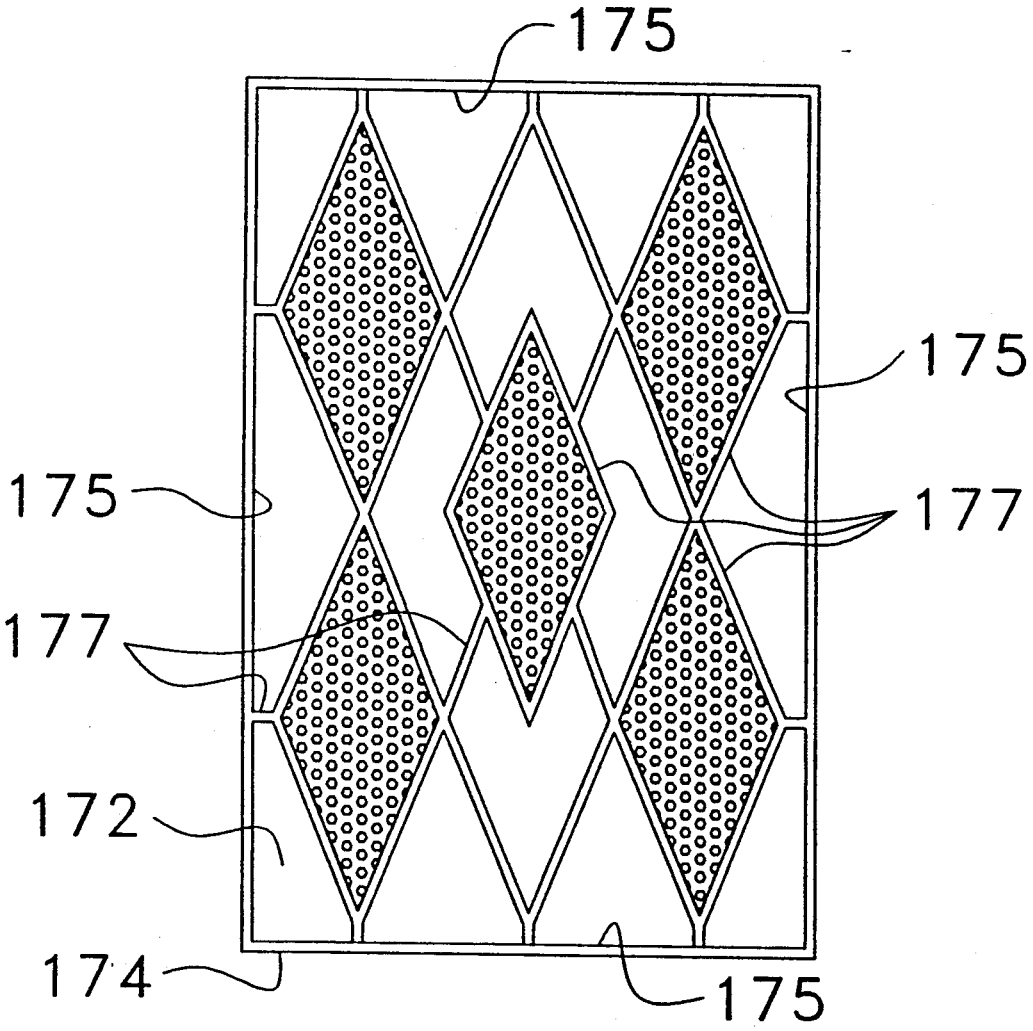
FIG. 24 is a view of another stained glass member constructed in accordance with the method of the present invention.

Another stained glass member constructed in accordance with the present invention is illustrated in FIG. 24. It is noted that in connection with the discussion of FIGS. 1–23, that the proportions of the various elements have been exaggerated in order to illustrate the construction more clearly. In addition, a relatively small window was picked also for purposes of illustration. A more realistic situation is shown in FIG. 24. In particular, FIG. 24 illustrates a sandwich glass member comprising a finishing glass pane 174 adhered to a stained glass element 172. In connection with the taping step illustrated in FIGS. 4 and 5, it is noted that sides 175 which will be the outside of the stained glass element 172 do not need to be taped. On the other hand, all other sides 177 should be taped.

While an illustrative embodiment of the invention has been described above, it is, of course, understood that various modifications will be apparent to those of ordinary skill in the art. Such modifications are within the spirit and scope of the invention, which is limited and defined only by the appended claims.

INDUSTRIAL APPLICABILITY

The instant invention is particularly well suited toward mass production with relatively unskilled labor. In connection with this, it is noted that best results will be achieved if the gap 62 between stained glass panes have their widths kept in the range of 3/32 inches to $\frac{3}{8}$ inches. Joints wider than $\frac{3}{8}$ inches are not recommended because of the dragging of the silicon.

As alluded to above, the pattern must be a full-scale accurate reproduction of the desired finished unit. Glass cutting must be done precisely and hand grozing and undernipping is not an acceptable method of manufacture. Likewise, broken corners cannot be tolerated since defects will show in the finished unit. Rather al modifications to the shape of the stained glass panes should be done by sanding or grinding. In addition, all edges of the glass should be dulled with sandpaper in order to allow for swift and safe assembly.

Glass having a dimension of $\frac{1}{8}$ or $\frac{1}{4}$ inches is appropriate. In view of the fact that silicon caulking is the preferred material, the glass should be cleaned carefully from dirt, oil, kerosene, and the like. The application of silicon should be done a section at a time since silicon tends to set quickly and the silicon must be quickly tooled into the joints. The same may be done using the finger or an appropriate flexing tooling knife or wooden spatula. The tool, whether it be the finger, a metal or a wooden device, should be used immediately after application of the silicon with a silicon caulking gun whose nozzle has been cut to a width which substantially equals that of the gap. At first, the silicon should be gently worked with the finger or tool very softly. The particular section is then marked with somewhat greater pressure as more material is filled into the gap.

In order to avoid cutting of the fingers by the sharp edges of the cut stained glass panes, these edges are dulled with sandpaper or other appropriate means. Finally, on the third pass a little more pressure is used which is sufficient to introduce the compound onto the masking tape.

While it is preferred to allow the silicon to dry for twenty-four hours prior to removal of the tape, slightly shorter periods can be tolerated provided that additional care is taken. During the step illustrated in FIGS. 16 and 17, the filling in of silicon caulking material into holes 66, 68 and 70 may be advantageous to lift one end of the assembly on the table so that the glass is at approximately a forty-five degree or larger angle to the table allowing the fabricator to see the bottom of the glass and ensure that sufficient material is introduced into the holes to ensure good adhesion while being sure that not too much material is introduced into the holes so as to create unsightly excess material. Likewise, as alluded to above, the filling of the holes should be done while the masking tape is on the perimeter of the stained glass panes.

Referring to FIG. 24, the masking material adjacent sides 177 may be removed quickly. On the other hand, the masking material may be introduced on the edges of 175 of the unit and these strips of masking tape should not be removed until sufficient drying has occurred, typically after twenty-four hours.

While an illustrative embodiment of the invention has been described above, it is, of course, understood that various modifications will be apparent to those of ordinary skill in the art. Such modifications are within the spirit and scope of the invention, which is limited and defined only by the appended claims.

I claim:

1. Method of manufacturing a window, comprising an array of individual pane members and having the appearance of a conventional stained glass window, using a pattern, comprising the steps of:

(a) forming a plurality of pane members, said pane members having a face side and a reverse side;

(b) taping said face side of said pane members along edges of said pane members facing other edges of said pane members in said pattern;

(c) aligning said plurality of taped pane members with respect to each other, forming gaps between each of the adjacent pane members and forming the desired pattern;

(d) filling said gaps between each of the adjacent pane members with a caulking material;

(e) allowing said caulking material to harden to form said pane members into a unitary member with a periphery;

(f) removing portions of said caulking material to define gaps in the hardened caulking material;

(g) placing said unitary member on a finishing pane;

(h) placing uncured caulking material into said gaps where caulking material has been removed; and (i) bringing said uncured caulking material into contact with said finishing pane in order to adhere said unitary member to said finishing pane.

2. Method as claimed in claim 1 further comprising the steps of:

j) adhering spacers to the periphery of the adjoined pane members opposite said finishing pane;

k) adhering an external plate to said spacers; and l) sealing between said finishing pane and said external plate, around said adjoined pane members and spacers, forming a thermopane unit.

3. Method as claimed in claim 1, wherein said tape on said reverse side of said pane members is removed before adhering said pane members to said finishing pane.

4. Method as claimed in claim 1, wherein said tape on said face side of said panel members is removed before adhering said pane members to said finishing pane.

5. Method as claimed in claim 2, wherein said spacers are connected to each other by corner joints.

6. Method as claimed in claim 2, wherein said spacers are hollow and are filled with desiccant particles before being adhered to the periphery of said adjoined pane members.

7. Method as claimed in claim 2, further comprising the step of encasing said thermopane unit in a frame.

8. Method of manufacturing a stained glass window, using a pattern, comprising the steps of:

(a) forming glass or plastic into a plurality of pane members, said pane members having a face side and a reverse side;

(b) taping said face side of said pane members along the edges of said pane members facing other edges of other pane members in said pattern;

(c) aligning said plurality of taped pane members with respect to each other with said face side facing downwardly, forming gaps between each of the adjacent pane members and forming the desired pattern;

(d) covering said gaps between edges of adjacent pane members by placing tape extending over the gaps on said reverse side of said pane members to form said pane members into a coherent unit;

(e) turning over the aligned plurality of pane members;

(f) filling said gaps between each of the adjacent pane members with a caulking material by applying said caulking material from said face side toward said reverse side, joining said pane members to each other;

(g) allowing said caulking material to harden to form said pane members into a unitary member with a periphery;

(h) removing said tape on said reverse side of said pane members;

(i) removing portions of said caulking material to define gaps in the hardened caulking material;

(j) placing said unitary member on a finishing pane;

(k) placing uncured caulking material into said gaps where caulking material has been removed; and (l) bringing said uncured caulking material into contact with said finishing pane in order to adhere said unitary member to said finishing pane.

* * * * *